United States Patent [19]

Healy et al.

[11] Patent Number: 4,714,031

[45] Date of Patent: Dec. 22, 1987

[54] COMBUSTOR FEEDING ARRANGEMENT

[75] Inventors: John T. Healy, Irvine; Joel W. Johnson, Newport Beach, both of Calif.

[73] Assignee: Westinghouse Electric Corp., Pittsburgh, Pa.

[21] Appl. No.: 510

[22] Filed: Jan. 5, 1987

[51] Int. Cl.[4] ..... F23K 3/12; F23K 3/16

[52] U.S. Cl. ..... 110/109; 110/289; 414/198

[58] Field of Search ..... 110/109, 289, 290, 291, 110/116, 117, 114; 414/214, 176, 198

[56] References Cited

U.S. PATENT DOCUMENTS

| | | | |
|---|---|---|---|
| 1,887,191 | 11/1932 | Whitney | 110/290 |
| 1,936,962 | 11/1933 | Chamberlin | 110/109 |
| 3,680,719 | 8/1972 | Reilly | 110/109 X |
| 3,855,950 | 12/1974 | Hughes, Jr. et al. | 110/109 X |
| 3,938,451 | 2/1976 | Lucas, Jr. | 110/109 |

*Primary Examiner*—Edward G. Favors

*Attorney, Agent, or Firm*—F. J. Baehr, Jr.

[57] ABSTRACT

An arrangement for feeding material to the open end of a combustor including a vertical chute leading to a doorway to the combustor which is normally closed by a biased door, and a stepped ram reciprocating at the bottom of the chute for feeding material through the door and into the combustor.

6 Claims, 4 Drawing Figures

COMBUSTOR FEEDING ARRANGEMENT

This invention relates generally to rotary kilns, of a type becoming known as combustors, and more particularly concerns feeding burnable material to such a combustor.

U.S. Pat. No. 3,822,651, issued June 9, 1974, discloses an installation that has become especially useful for burning MSW (municipal solid waste) and generating useful steam as a result. The burning primarily takes place in a combustor drum consisting of a long cylindrical structure formed of water circulating pipes slowly rotating on the drum axis. The drum axis is slightly inclined so that material to be burned fed into the higher end tumbles while burning toward the low end.

Air for burning is fed through holes formed between the pipes making up a cylindrical drum wall, with the air flow being controlled by ducts fitting adjacent the lower portions of the rotating drum. A convenient arrangement for feeding the MSW to the combustor is through gravity, simply dumping material into a vertical chute opening into the upper end of the combustor. Such a design does, however, present problems. If the opening to the combustor is too large, material flows too rapidly into the combustor. If the opening is too small, large objects likely to be encountered in unclassified MSW will jam and block the flow of material.

Also, with an open upper end to the combustor, the amount and density of the material being fed affects air flow into the burning region, and this can upset the desired control of burning through regulation of combustion air.

Accordingly, it is an object of the invention to provide an arrangement for feeding burnable material to a combustor which gives accurate control of the rate at which such material is fed. More specifically, it is an object to provide an arrangement of this kind in which material feed is directly related to the rate at which a positive acting ram is operated.

Another object is to provide an arrangement of the foregoing kind that completely blocks the combustion material infeed opening so that uncontrolled combustion air flow is avoided and the possibility of backfire—unwanted ignition of the material being fed to the combustor—is prevented.

A further object is to provide an arrangement as characterized above that utilizes a positive acting ram that is shaped so that a large stroke is not required and hence permitting an exceptionally compact feeding arrangement.

Still another object is to provide an arrangement of the above kind that has a ram configuration that minimizes jamming of the combustion material feeding parts.

Other objects and advantages of the invention will become apparent upon reading the following detailed description, and upon reference to the drawings, in which.

Figure 1:
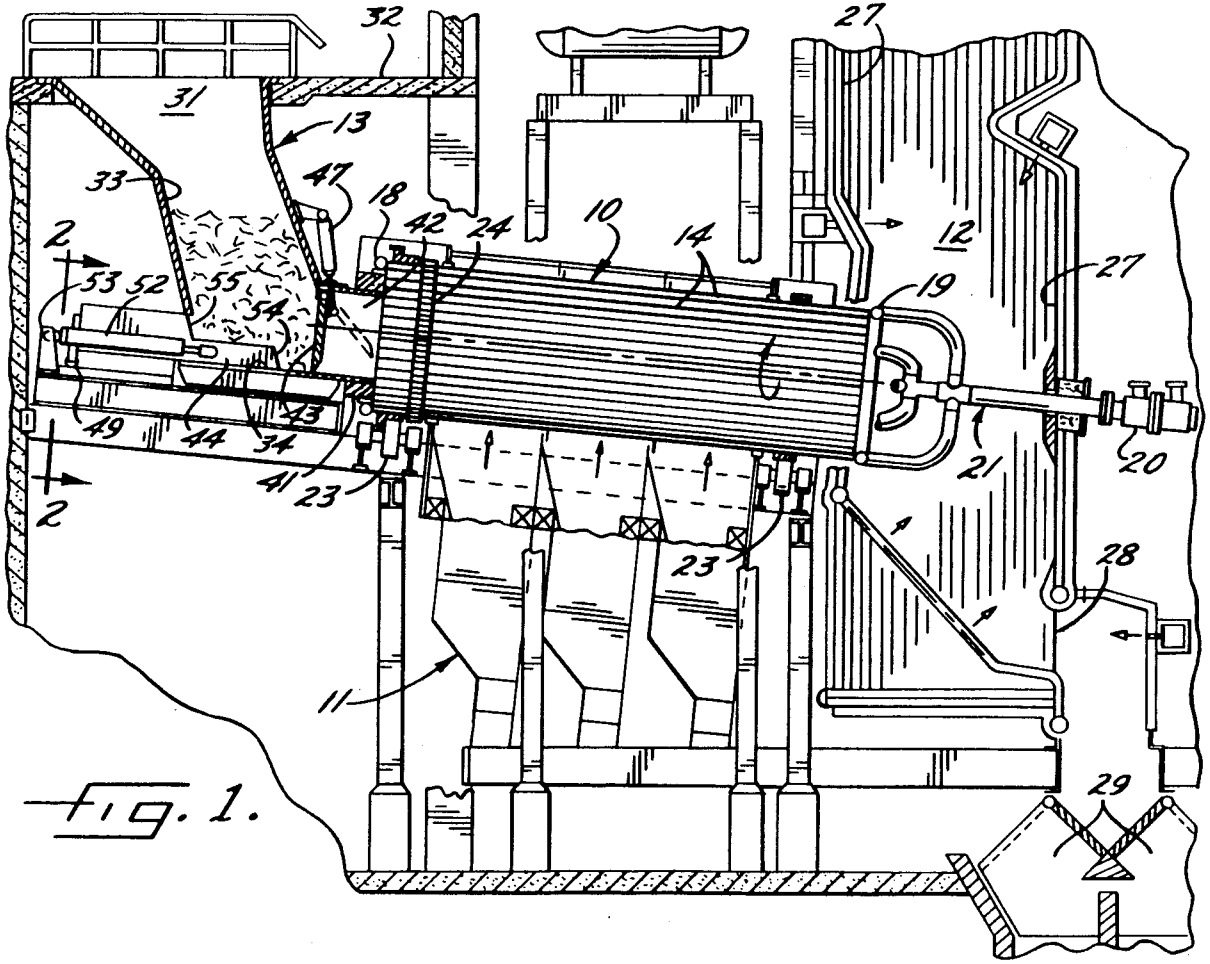
FIG. 1 is a fragmentary partially sectioned elevation of a structure for burning MSW including a material feeding arrangement embodying the invention.

While the invention will be described in connection with a preferred embodiment, it will be understood that I do not intend to limit the invention to that embodiment. On the contrary, I intend to cover all alternatives, modifications and equivalents included within the spirit and scope of the invention as defined by the appended claims.

Turning to the drawing, there is shown a structure for burning material such as MSW and including a rotary drum or combustor 10 with a windbox 11 for delivering air to the combustor 10, a furnace 12, and an arrangement 13 for feeding combustible material into the combustor. The combustor 10 is formed of a plurality of water cooled pipes 14 joined together by perforated strips welded between the pipes to define the cylindrical structure.

The pipes 14 end in annular header pipes 18 and 19 at each end of the cylinder. A rotary joint 20 feeds water to, and removes steam and hot water from, the combustor 10 through concentric pipes 21. Water is directed to the header 19, and thence to the combustor pipes 14, and steam from the header pipe 18 is carried back through certain ones of the combustor pipes 14 that do not carry input water and which communicate directly with the steam portion of the pipes 21.

The combustor 10 is mounted for rotation about the axis of the cylindrical structure on support rollers 23 with the axis being tilted so that the combustor has a high end and a low end. The combustor is slowly rotated through a sprocket 24 in the direction of the arrow in FIG. 1.

The furnace 12 is defined by a plurality of boiler pipes 27 having a side opening for the combustor 10 and a bottom opening 28 leading to chutes 29 for ashes and non-burnable materials. The arrangement 13 for feeding combustible material includes a chamber 31 beneath the level of a floor 32 from which material can be dumped into the open chamber. The chamber opens to a generally vertical chute 33 ending with a lower floor 34 leading to the open higher end of the combustor 10.

As observed above, a basic combustor is further disclosed in said Pat. No. 3,822,651, and a windbox air flow control is disclosed in Ser. No. 942,570, filed 12-15-86; said disclosures being hereby specifically incorporated by reference.

In accordance with the invention, a wall 41 closes the open end of the combustor 10 and defines a doorway 42 normally closed by a biased door 43, and a stepped ram 44 reciprocates over the floor 34 to positively push material into and through the doorway 42. The illustrated doorway 42 is roughly square in cross section, and the door 43 is pivoted on a shaft 46 at the top. The door 43 is biased by a linear actuator 47 toward the down, closed position. The actuator 47 engages the door 43 through a flexible member 48 covering an opening in the top of the doorway 42.

Figure 3:
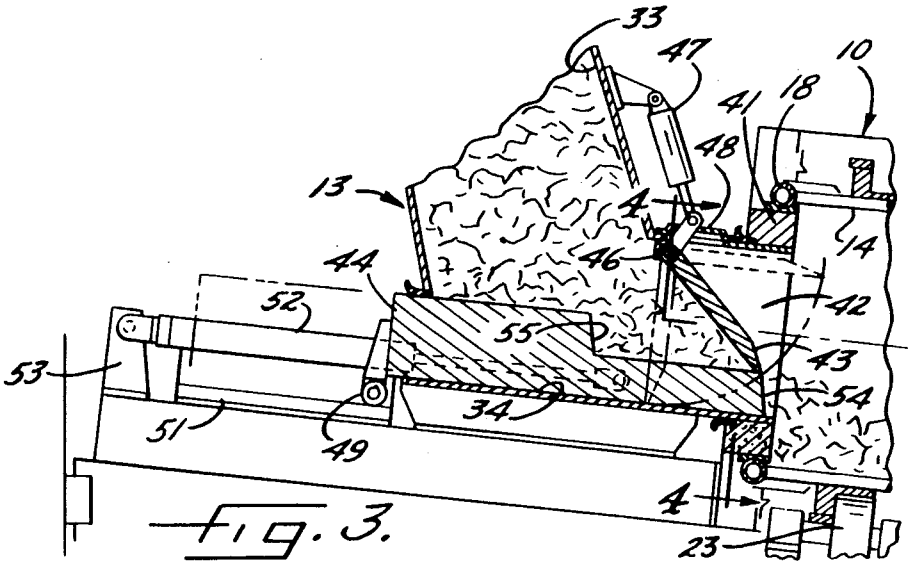
FIG. 3 is a fragmentary slightly enlarged vertical section of a portion of the structure shown in FIG. 1.
Figure 4:
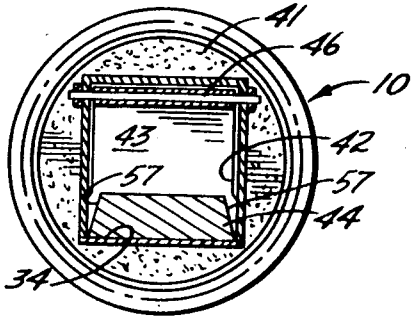
FIG. 4 is a partial section taken approximately along the line 4—4 in FIG. 3.
Figure 2:
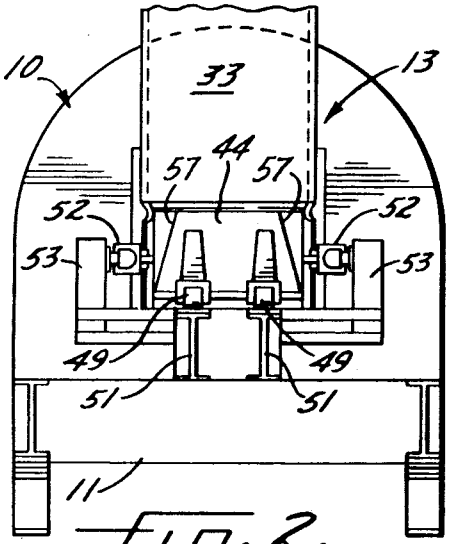
FIG. 2 is a fragmentary section taken approximately along the line 2—2 in FIG. 1.

The ram 44 slides on the floor 34 but much of the weight of the material on the top of the ram is borne by rollers 49 mounted on the rear of the ram which ride on beams 51. The ram 44 is powered by a pair of double-acting linear actuators 52 anchored at 53 and engaging the sides of the ram. The stepped ram 44 includes a first face 54 adjacent the floor 34 and a second face 55 above the first face and spaced from the door 43. In the feeding position of the ram 44, FIG. 3, the first face 54 has pushed material through the doorway 42, the door 43 having been forced back and up to clear the ram. The second face 55 has moved material from the lower back of the chute 33 toward the doorway. When the ram 44 retreats to its withdrawn position, FIG. 1, the door 42 is closed, the second face 55 clears the chute 33 and the first face 54 is positioned to feed the next load of material through the doorway 42 and into the combustor.

The ram 44 is formed in cross section with sloping sides 57 so that the top surfaces of the ram are smaller than the ram base and there is no close fitting between the ram sides 57 and the side or vertical edges of the doorway 42. Experience has shown that close fitting of the ram shape to the sides of the structure in which the ram reciprocates tends to result in jamming, and that wear at the ram sides after long periods of use increases the risk of jamming. By providing the tapered or sloping sides 57, the possibility of jamming is minimized, but there is still adequate area on the faces 54, 55 to insure positive feeding.

Preferably, the actuator 47 is double-acting so that it can be utilized to open the door 43 for observation or servicing. The utilization of a hydraulic actuator to bias the door permits substantial biasing forces to be exerted so as to positively keep the doorway 33 closed against the weight of MSW in the chute 33. The actuators 52 of course must exert more pressure than the biasing force exerted by the actuator 47 so that the door is opened when the ram is actuated.

For simplicity, the door 43 is shown as being solid, but preferably it, like the walls of the combustor 10, is also water cooled which is accomplished by forming the door as a hollow metal panel and circulating water through the hollow interior of the panel via passages formed in the pivot shaft 46.

It can be seen that the stepped configuration of the ram 44 minimizes the total distance through which the ram is reciprocated so that a long ram stroke is not required. The total feeding arrangement can therefore be embodied in a compact design at the forward or upper end of the combustor.

It can also be seen that the door 43 positively closes the upper end of the combustor against air flow so that combustion is controlled through the windboxes 11. The doorway 42 can be designed to be of a sufficiently large size to pass large objects embodied in the MSW without those objects jamming the feed of the combustible material but, despite the size of the doorway, feed of the material into the combustor is dictated by the rate at which the ram 44 is reciprocated.

I claim as my invention:

1. A feeding arrangement for a combustor having an open end for receiving combustible material comprising, in combination, a wall closing said open end of said combustor and defining a doorway, a generally vertical chute including said wall, leading to said doorway and having a lower floor aligned with the bottom of the doorway, a ram mounted for reciprocation over said lower floor and into and through said doorway, a door mounted to normally close said doorway and being movable to open the doorway when pushed by said ram and combustible material, means for biasing said door toward a closed position, and means for reciprocating said ram, said ram, door and biasing means cooperating to positively push material into and through said doorway by only reciprocating said ram.

2. The combination of claim 1 in which said door is pivoted to swing up from said floor and away from said ram, and said biasing means including a hydraulic actuator providing adjustable pressure to maintain the doorway closed until opened under the force of said ram.

3. The combination of claim 2 in which said actuator is double acting so that the actuator can be operated to open said door for observation or servicing.

4. The combination of claim 1 in which said ram is stepped and has a first face adjacent said floor and a second face above said first face and spaced from said door.

5. The combination of claim 4 in which said ram has sloped sides so that the top surfaces of the ram are smaller than the ram base.

6. A feeding arrangement for a combustor having an open end for receiving combustible material comprising, in combination, a wall closing said open end of said combustor and defining a doorway, a generally vertical chute including said wall, leading to said doorway and having a lower floor aligned with the bottom of the doorway, a ram mounted for reciprocation over said lower floor into and through said doorway, said ram being stepped and having a first face adjacent said floor and a second face above said first face and spaced from said doorway, the sides of the said ram being sloped so that the top surfaces of the ram are smaller than the ram base, and means for reciprocating said ram, said ram, door and biasing means cooperating to positively push material into and through said doorway by only operating said ram.

* * * * *